US007758474B1

(12) United States Patent
Pedrini

(10) Patent No.: US 7,758,474 B1
(45) Date of Patent: Jul. 20, 2010

(54) WHEEL MOUNT FOR A BICYCLE TRAINER

(75) Inventor: Fabio Pedrini, Bologna (IT)

(73) Assignee: Saris Cycling Group, Inc., Madison, WI (US)

( * ) Notice: Subject to any disclaimer, the term of this patent is extended or adjusted under 35 U.S.C. 154(b) by 0 days.

(21) Appl. No.: 12/116,007

(22) Filed: May 6, 2008

(51) Int. Cl.
*A63B 69/16* (2006.01)

(52) U.S. Cl. ..... 482/61; 434/61

(58) Field of Classification Search ..... 482/51, 482/54, 57, 61, 148, 908; 434/61; 464/36, 464/37, 38, 40
See application file for complete search history.

(56) References Cited

U.S. PATENT DOCUMENTS

| | | | | |
|---|---|---|---|---|
| 4,969,642 | A | 11/1990 | Phillips | |
| 5,026,047 | A * | 6/1991 | Kosecoff | 482/59 |
| 5,397,285 | A | 3/1995 | Haan et al. | |
| 5,433,681 | A | 7/1995 | Minoura | |
| 5,728,029 | A * | 3/1998 | Minoura | 482/61 |
| 6,019,708 | A * | 2/2000 | Kaminski et al. | 482/57 |
| 6,203,472 | B1 * | 3/2001 | McCaffrey et al. | 482/61 |
| 6,620,081 | B2 | 9/2003 | Phillips | |
| 6,659,917 | B1 * | 12/2003 | Tacx | 482/63 |
| 6,736,761 | B2 * | 5/2004 | Huang | 482/57 |
| 7,407,466 | B2 * | 8/2008 | Chiu | 482/61 |
| 7,481,748 | B2 * | 1/2009 | Schroeder | 482/61 |
| 2004/0053751 | A1 * | 3/2004 | Pizolato | 482/61 |

OTHER PUBLICATIONS

"CycleOp's Owner's Manual For The FLUID$^2$, MAGNETO, MAG, MAG+, AND WIND Trainers", 14919D, Jul. 2006, 8 pages.

* cited by examiner

*Primary Examiner*—Loan H Thanh
*Assistant Examiner*—Tam Nguyen
(74) *Attorney, Agent, or Firm*—Boyle Fredrickson, S.C.

(57) ABSTRACT

A bicycle trainer includes a frame, a resistance unit interconnected with the frame, and a wheel mounting arrangement for securing the bicycle wheel to the frame. The wheel mounting arrangement includes first and second spaced apart wheel engagement areas, one of which includes a threaded wheel engagement member. A fixed-position threaded actuator member is rotatably interconnected with the frame. Rotation of the actuator member causes extension and retraction of the wheel engagement member, to move the wheel engagement member toward and away from the second wheel engagement area, and to selectively clamp the wheel between the second wheel engagement area and the wheel engagement member. The threads of the actuator member and the wheel engagement member are lead threads, and a guide arrangement is associated with the threaded wheel engagement member for guiding inward and outward movement of the wheel engagement member upon rotation of the actuator member.

17 Claims, 6 Drawing Sheets

WHEEL MOUNT FOR A BICYCLE TRAINER

BACKGROUND AND SUMMARY OF THE INVENTION

This invention relates to an exercise device such as a bicycle trainer, and more particularly to a feature for securing the driven wheel of a bicycle to the frame of a bicycle trainer.

A bicycle trainer typically includes a frame that is configured to support the driven wheel of a bicycle, and a resistance unit carried by the frame that is engageable with the bicycle wheel to resist rotation of the wheel upon application of input power to the bicycle pedals by a user. Typically, the driven wheel of the bicycle is secured to the bicycle trainer frame using opposed clamping members secured to spaced apart areas of the frame. In one exemplary prior art configuration, an adjustable stationary clamping member engages one end of the skewer, and a movable clamping member is moved into and out of engagement with the opposite end of the skewer. The movable clamping member is movable throughout a fixed range of movement between a clamping position and a release position. Representatively, the movable clamping member is moved inwardly and outwardly in response to operation of an actuator, which may be in the form of an outwardly extending shaft that is guided for movement within a spiral slot formed in a mounting area of the frame. With this construction, the user adjusts the position of the stationary clamping member according to the length of the skewer. The user can then mount his or her bicycle to the frame by engaging one end of the skewer with the stationary clamping member, and operating the actuator to move the movable clamping member into engagement with the opposite end of the skewer.

While the above-described wheel mounting construction functions well, it is somewhat disadvantageous in that bicycle skewers have different lengths. Thus, when a bicycle having a skewer with a different length is to be the frame of the trainer, the position of the stationary clamping member must be adjusted to accommodate the skewer length. There is thus a need for a wheel mount for a bicycle trainer which provides quick and easy mounting of bicycle wheels having skewers of differing lengths.

In accordance with the invention, a bicycle trainer for use with a bicycle having a driven wheel includes a frame, a resistance arrangement interconnected with the frame, and a wheel mounting arrangement associated with the frame for securing the bicycle wheel to the frame. The wheel mounting arrangement includes first and second spaced apart wheel engagement areas. At least the first the first wheel engagement area includes a threaded wheel engagement member and a threaded actuator member rotatably interconnected with the frame. The threaded wheel engagement member is engaged with the threaded actuator member such that rotation of the threaded actuator member causes extension and retraction of the threaded wheel engagement member so as to move the threaded wheel engagement member toward and away from the second wheel engagement area. In this manner, the bicycle wheel is clamped between the second wheel engagement area and the threaded wheel engagement member. The threaded actuator member is located in a fixed position on the frame, and includes one or more finger engagement members configured to facilitate manual engagement of the threaded actuator member by a user. The threaded actuator member may define a hub section, and the one or more finger engagement members may be in the form of a series of wing members that extend outwardly from the hub section.

The threads of the actuator member and the threads of the wheel engagement member are in the form of lead threads, and a guide arrangement is associated with the threaded wheel engagement member for guiding inward and outward movement of the wheel engagement member upon rotation of the threaded actuator member. With this construction, the lead threads of the actuator member and the wheel engagement member cooperate to cause axial inward and outward movement of the wheel engagement member upon rotation of the threaded actuator member.

The frame defines a laterally extending passage, and the wheel engagement member is interconnected with a sleeve positioned within the laterally extending passage. The guide arrangement is interposed between the sleeve and the wheel engagement member, and may be in the form of a laterally extending slot in the sleeve, and an outward projection associated with the wheel engagement member. The projection is engaged within the slot, and moves within the slot, to guide inward and outward movement of the wheel engagement member upon rotation of the threaded actuator member. The threaded actuator member may be rotatably interconnected with the sleeve.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
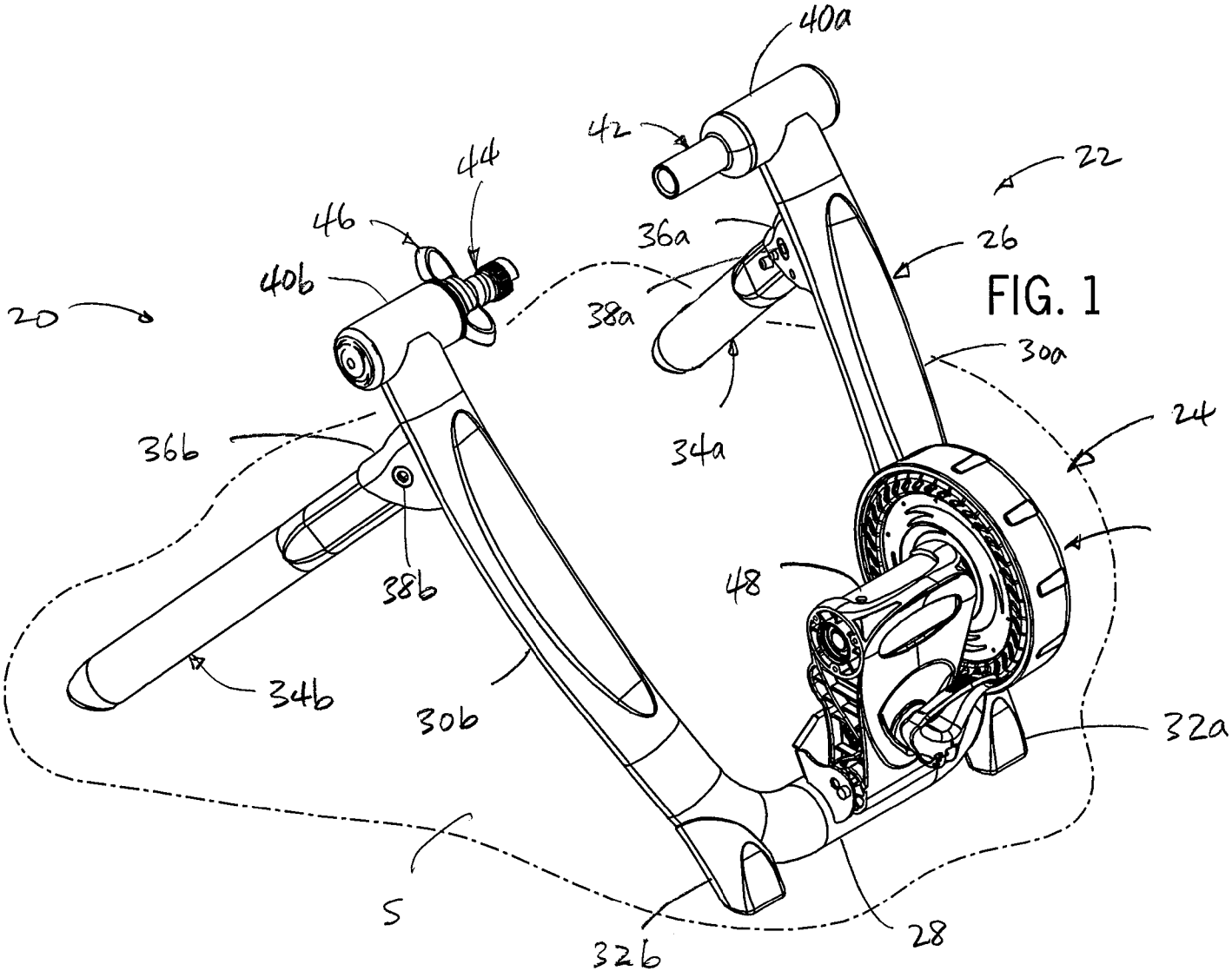
FIG. 1 is an isometric view of a bicycle trainer incorporating the wheel mount in accordance with the present invention.

Referring to FIG. 1, a bicycle trainer incorporating wheel mounting feature in accordance with the present invention is generally shown at 20. The bicycle trainer 20 includes a frame generally shown at 22 to which a resistance unit 24 is mounted. In a manner as is known, the resistance unit 24 may provide resistance to rotation of a bicycle wheel using any satisfactory type of resistance arrangement such as, but not limited to, a fluidic, magnetic, electronic, wind or other resistance arrangement. The resistance unit 24 is movably mounted to the frame 22, to enable the resistance unit 24 to be moved into and out of engagement with the bicycle wheel.

The frame 22 is formed of a generally U-shaped main support 26 that defines a base member 28 and a pair of support arms 30*a* and 30*b* that extend upwardly from opposite ends of base member 28. A pair of rear feet, shown at 32*a* and 32*b*, are secured to main support 26 near the intersection of base member 28 and support arms 30*a*, 30*b*, respectively. Feet 32*a*, 32*b* are configured to provide support for the rear area of frame 22 on a support surface S, such as a floor.

A pair of front legs, shown at 34*a*, 34*b*, are secured to support arms 30*a*, 30*b*, respectively. Each front leg 34*a*, 34*b* is preferably mounted to its respective support arm 30*a*, 30*b* by means of a pivot connection, which enables the front legs 34*a*, 34*b* to be moved from an extended position as shown, and a collapsed position for transport and storage. In the collapsed position, the front legs 34*a*, 34*b* are pivoted toward the support arms 30*a*, 30*b*, respectively, so that the front leg 34*a* is generally parallel to the support arm 30*a* and the front leg 34*b* is generally parallel to the support arm 30*b*. In the illustrated embodiment, front legs 34*a*, 34*b* are pivotably secured to respective support arms 30*a*, 30*b* via respective hinge brackets 36*a*, 36*b* and hinge pins 38*a*, 38*b*, although it is understood that any other satisfactory pivotable mounting arrangement may be employed. In a manner as is known, hinge brackets 36*a*, 36*b* are configured to act as stops that limit outward movement of respective front legs 34*a*, 34*b* to the operative extended position as shown in FIGS. 1-3, while enabling front legs 34*a*, 34*b* to be pivoted about respective hinge pins 38*a*,38*b* inwardly to the inoperative collapsed position against respective support arms 30*a*, 30*b*.

Figure 2:
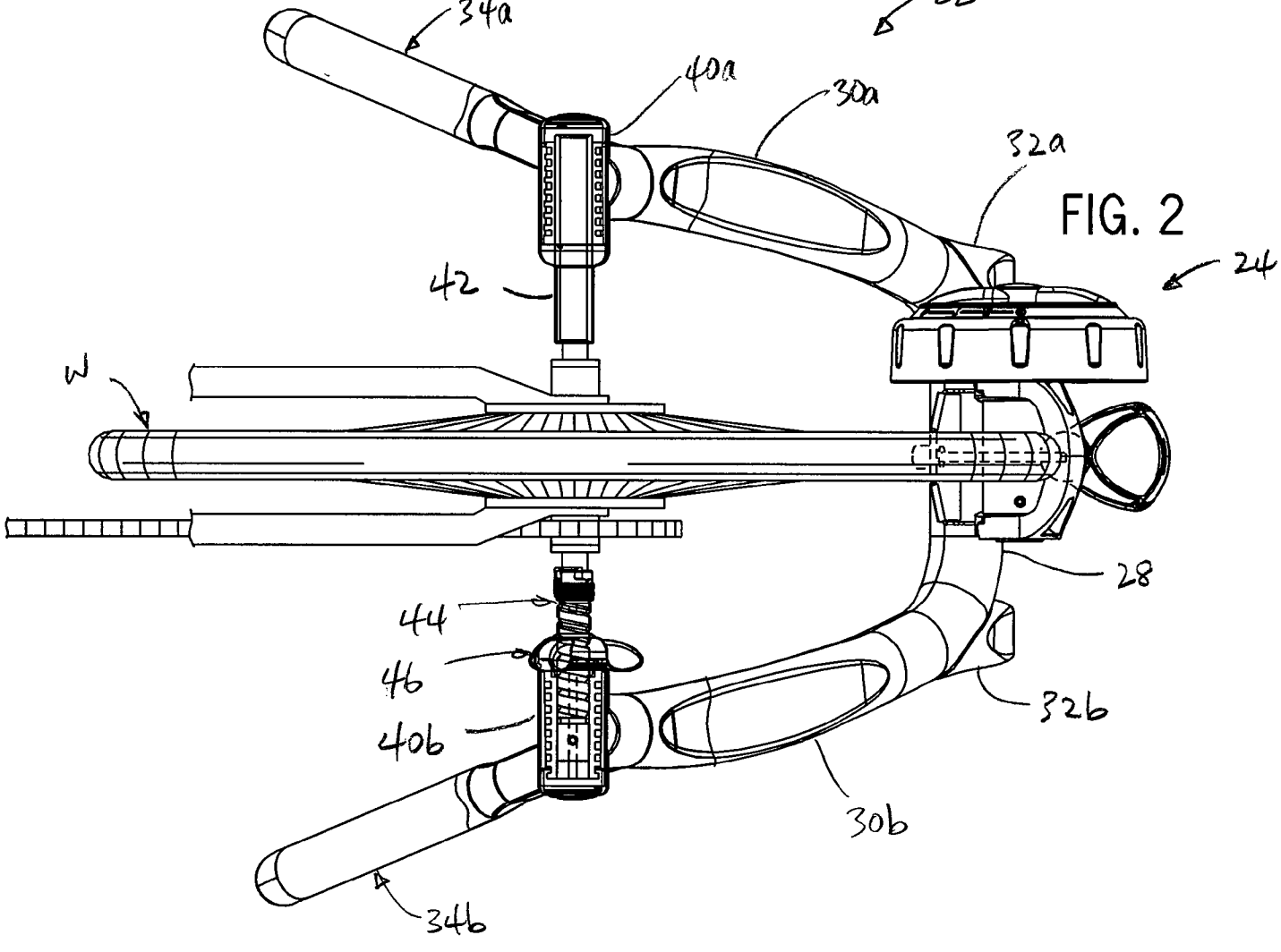
FIG. 2 is a top plan view of the bicycle trainer of FIG. 1, showing use of the wheel mount in accordance with the present invention for mounting the driven wheel of the bicycle to the bicycle trainer.
Figure 3:
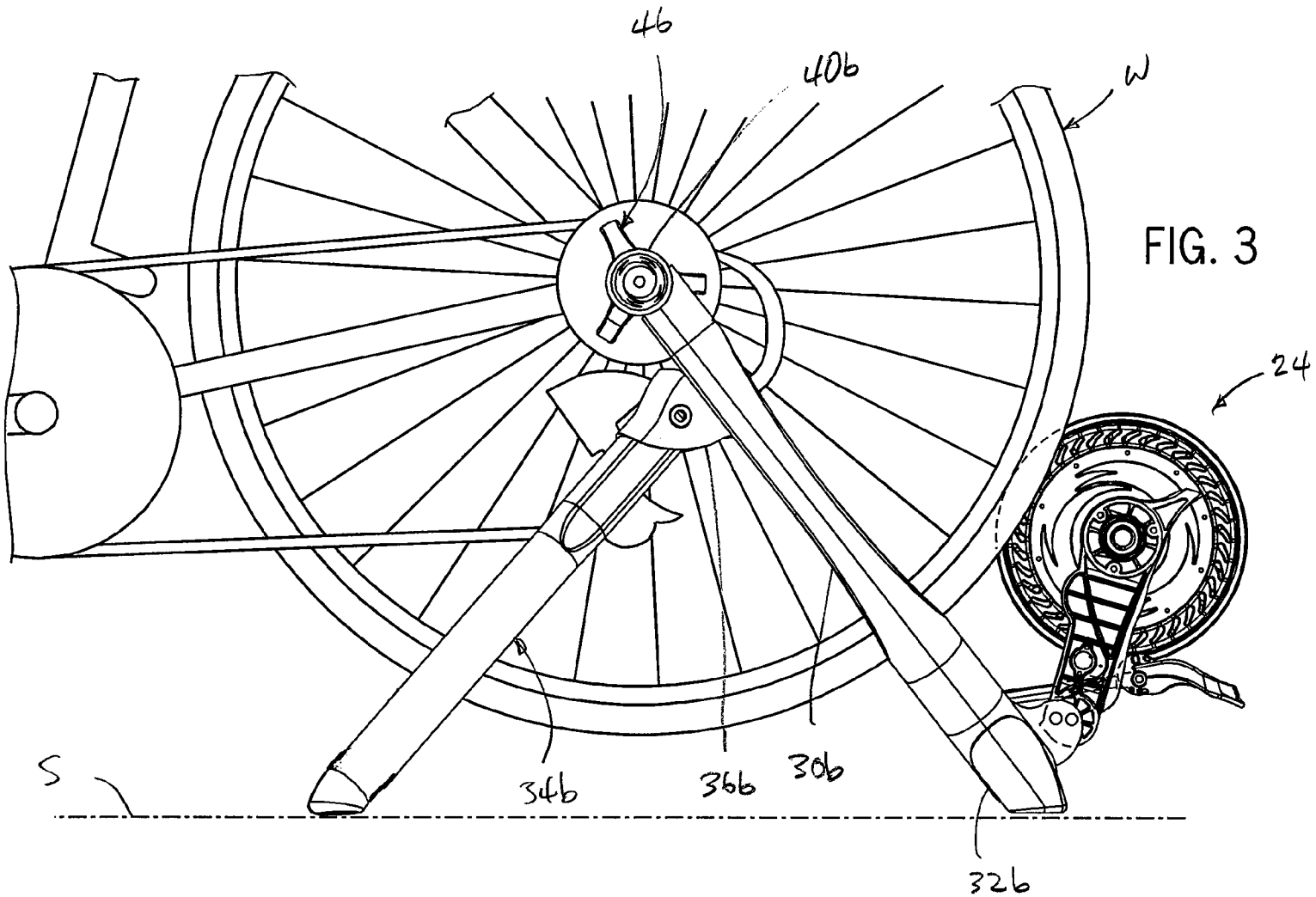
FIG. 3 is a side elevation view of the bicycle trainer and bicycle wheel as shown in FIG. 2.

Support arms 30*a*, 30*b* include a wheel mounting arrangement in accordance with the present invention, which enables a bicycle wheel W to be secured to frame 22 of trainer 20 such that bicycle wheel W is supported above support surface S, as shown in FIGS. 2 and 3. In the illustrated embodiment, the wheel mounting arrangement includes a pair of spaced apart, aligned tubular frame sections 40*a*, 40*b* secured to the upper ends of respective support arms 30*a*, 30*b*, and wheel engagement components interconnected with frame sections 40*a*, 40*b* for clamping bicycle wheel W therebetween. The wheel engagement components include a stationary wheel engagement member 42 secured to and extending inwardly from frame section 40*a*, and a movable wheel engagement member 44 secured to and extending inwardly from frame section 40*b*. As will later be explained, the movable wheel engagement member 44 is movable toward and away from the stationary wheel engagement member 42 in response to rotation of a rotatable actuator 46 interconnected with frame section 40*b*. In this manner, the stationary and movable wheel engagement members 42, 44, respectively, are engaged with the ends of the skewer of bicycle wheel W, as shown in FIG. 2, to clamp the skewer therebetween and to thereby rotatably secure the bicycle wheel W to the frame 22.

When the bicycle wheel W is secured to the frame 22, the resistance unit 24 may be moved into engagement with the wheel W so as to resist rotation of wheel W when wheel W is rotated in response to input power applied to the bicycle pedals by a user. The resistance unit 24 includes a roller 48 that is engaged with the tire of the bicycle wheel W, and typically includes a flywheel connected to roller 48 that is contained within a cover 50. As is explained more fully in copending application Ser. No. 12/116,001, filed May 6, 2008, the disclosure of which is hereby incorporated by reference, the resistance unit 24 is pivotably secured to base member 28 of frame 22 so as to be selectively movable toward wheel W for engagement with the tire of wheel W, and selectively movable away from wheel W out of engagement with the tire of wheel W.

Figure 4:
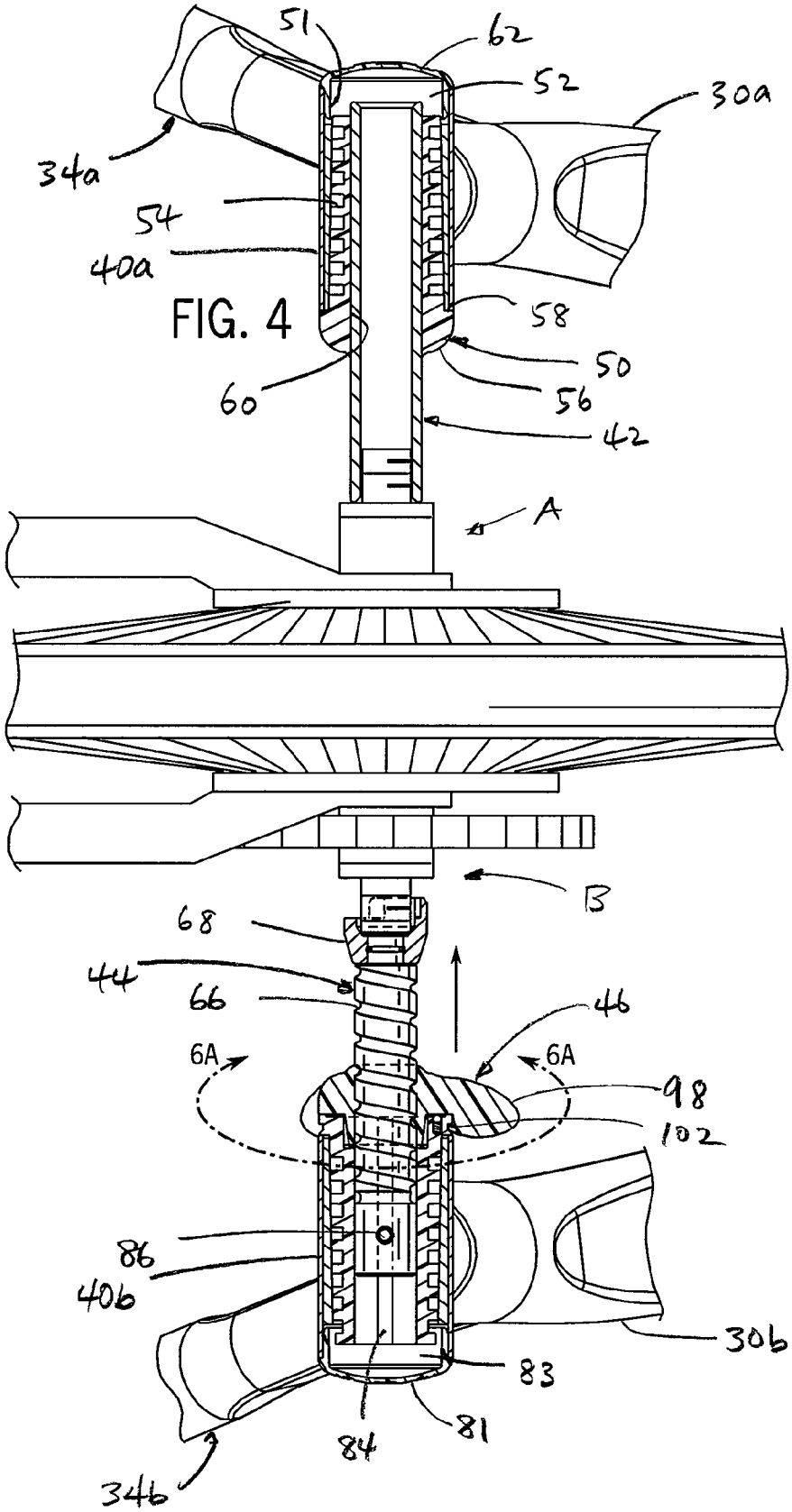
FIG. 4 is an enlarged partial top plan view of the bicycle trainer and bicycle wheel shown in FIGS. 3 and 4, with portions in section, showing details of the wheel mount in accordance with the present invention.
Figure 5:
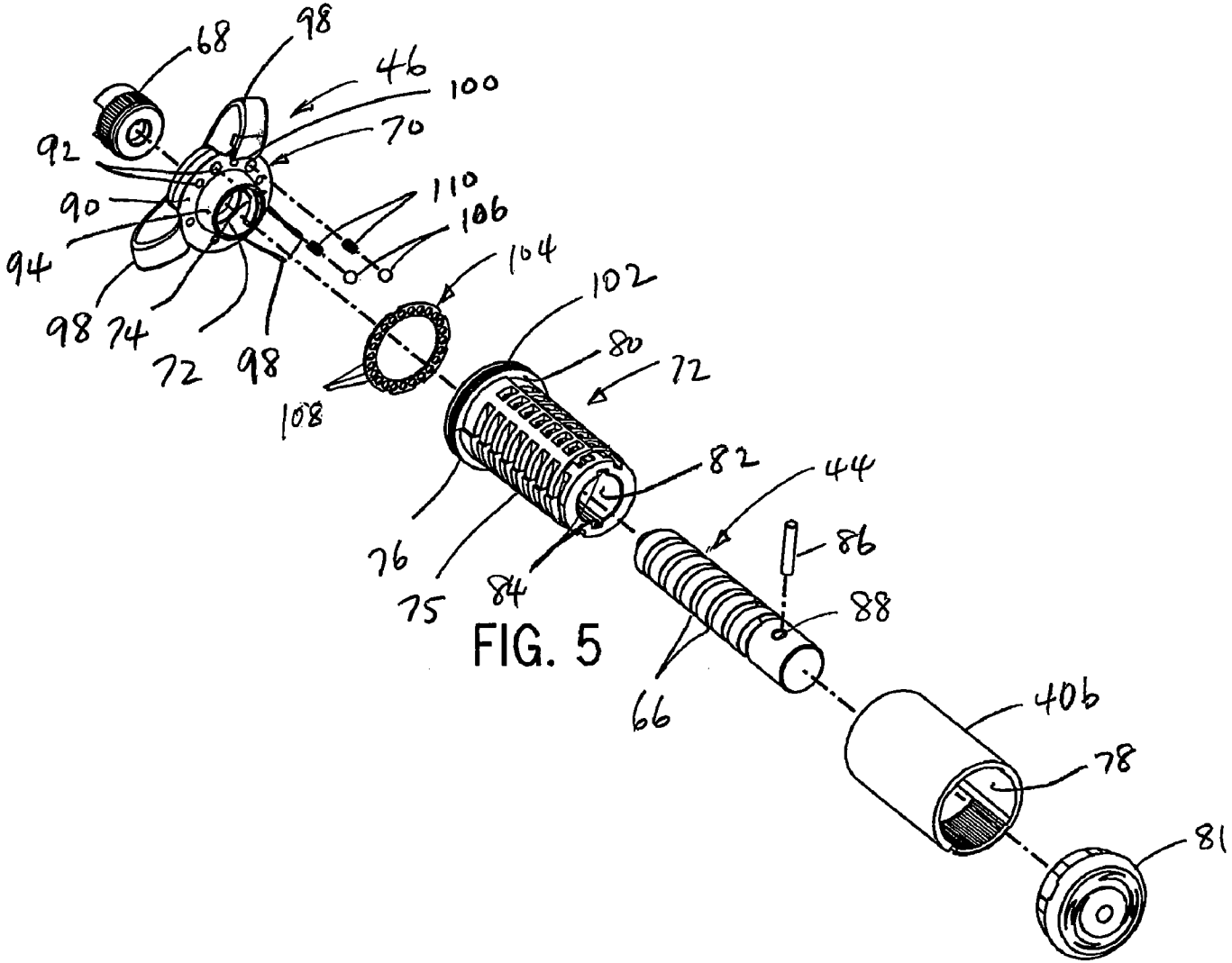
FIG. 5 is an exploded isometric view of the components incorporated in the wheel mount of the present invention as shown in FIG. 4, including the wheel engagement member and rotatable actuator member.

FIGS. 4 and 5 illustrate in detail the wheel mounting components of the bicycle trainer 20 in accordance with the present invention.

As shown in FIG. 4, the stationary wheel engagement member 42 is in the form of a tubular member having an outer end that is engageable with one end of the bicycle skewer, shown at A. The inner end of the wheel engagement member 42 is secured to a mounting sleeve 50, which is engaged with frame section 40*a* through a cylindrical adapter 51. In the illustrated embodiment, frame section 40*a* defines an internal passage 52 within which adapter 51 is received, and mounting sleeve 50 includes an inner mounting section 54 that is received within the passage defined by adapter 51. Adapter 51 is securely fixed to frame section 40*a* in any satisfactory manner so that adapter 51 and mounting sleeve 50 are secured within the passage 52 of frame section 40*a*. Mounting sleeve 50 further includes an outer section 56 located exteriorly of passage 52. Outer section 56 defines a shoulder 58 that is seated against the inner end of frame section 40*a*. Mounting sleeve 50 is formed with an internal passage 60, within which stationary wheel engagement member 42 is secured in any satisfactory manner. A cap 62 is secured to the open outer end of frame section 40*a*, so as to prevent access to internal passage 52.

It should be understood that the above description of the components of bicycle trainer 20 that are used to engage the end A of the skewer is representative of any satisfactory arrangement that provides a fixed position at which the end A of the bicycle skewer is engaged.

Opposite stationary wheel engagement member 42, movable wheel engagement member 44 is secured to frame section 40*b* so as to be movable inwardly and outwardly relative to frame section 40*b* by operation of actuator 46. Movable wheel engagement member 44 is in the form of an axially extending shaft formed with external lead-type screw threads 66. A skewer engagement member 68 is secured to the outer end of wheel engagement member 44, and has a conventional configuration that is adapted to engage the end of the bicycle skewer, shown at B. The actuator 46 defines a central hub 70 that is formed with a passage 71, within which internal threads 74 are formed. The internal threads 74 of actuator 46 are engaged with the external threads 66 of wheel engagement member 44, such that rotation of actuator 46 causes inward and outward movement of wheel engagement member 44.

Both actuator 46 and wheel engagement member 44 are secured to frame section 40*b* via a mounting sleeve 72, which includes an inner mounting section 75 and an outer section 76. The inner mounting section 75 is adapted to be received and engaged within a passage 78 defined by an adapter 79, which in turn is configured for engagement within a passage 83 defined by frame section 40*b*. Adapter 79 is securely fixed to frame section 40*b* in any satisfactory manner so that adapter 79 and mounting sleeve 72 are secured within the passage 83 of frame section 40*b*. The outer section 76 defines a shoulder 80, which is adapted to engage the inner and a frame section 40*b*. A cap 81 is secured to the open outer end of frame section 40*b*, so as to prevent access to internal passage 78.

Movable wheel engagement member 44 is received within a passage 82 defined by mounting sleeve 72. Wheel engagement member 44 has a diameter that is only slightly less than the diameter of passage 82, to provide close tolerance between wheel engagement member 44 and the wall of sleeve 72 that defines passage 82. A guide arrangement is interposed between wheel engagement member 44 and mounting sleeve 72, so as to guide inward and outward movement of wheel engagement member 44 relative to mounting sleeve 72. In the illustrated embodiment, the guide arrangement is in the form of a pair of opposed grooves 84 located within passage 82, in combination with a transverse guide pin 86 that is secured within a transverse passage 88 formed in the inner end of wheel engagement member 44. The ends of guide pin 86 extend outwardly from wheel engagement member 44, and are received within grooves 84. With this arrangement, engagement of the ends of pin 86 within grooves 84 prevents rotation of wheel engagement member 44, and guides axial inward and outward movement of wheel engagement member 44 upon rotation of actuator 46. Grooves 84 are preferably formed so as to extend axially within passage 82, although it is understood that grooves 84 may have any other desired configuration. With the axial configuration of grooves 84 as shown, wheel engagement member 44 is moved axially inwardly and outwardly, without rotation, when actuator 46 is rotated to extend or retract wheel engagement member 44.

Hub 70 of actuator 46 defines an inner face 90, within which a series of radially spaced indentations 92 are formed. A guide lug 94 extends inwardly from inner face 90 and is adapted to be received within a circular recess 96 (FIG. 4) that extends inwardly from the inner end of outer section 76 of mounting sleeve 72.

Actuator 46 further includes a series of radially spaced wings or actuator members 98, which extend outwardly from hub 70. The actuator members 98 are adapted to be manually engaged by a user in order to impart rotation to actuator 46. Adjacent inner face 90 of actuator hub 70, each actuator member 98 defines a radiused inner surface facing wheel engagement member 44, and having a radius that matches that of wheel engagement member 44. One of actuator members 98 is configured so as to define a tab 100 that is spaced inwardly from the inner face 90. The tab 100 is configured to be received within a circumferential groove 102 defined by outer section 76 of mounting sleeve 72. Tab 100 is engaged within groove 102 so as to maintain coaxial positioning between actuator 46 relative to mounting sleeve 72. Tab 100 and the radiused inner surfaces of actuator members 98 also functios to guide rotatable movement of actuator 46 on mounting sleeve 72, and tab 100 prevents axial movement of actuator 46 relative to mounting sleeve 72.

A retainer arrangement is interposed between actuator 46 and mounting sleeve 72 in order to maintain actuator 46 in a desired position relative to mounting sleeve 72 when actuator 46 is disengaged by the user. In the illustrated embodiment, the retainer arrangement is in the form of a ring 104 that is positioned against the inner face of outer section 76 of mounting sleeve 72, in combination with a series of biased retainer balls carried by actuator 46. Ring 104 defines a series of radially spaced openings 108, and balls 106 are adapted to be engaged within openings 108. Each retainer ball 106 is biased against ring 104 via a spring 110 received within a recess 111 formed in hub section 70, and balls 106 are received within the indentations 92 formed in the inner face 90 of hub section 70. With this construction, as actuator 46 is rotated relative to mounting sleeve 72 so as to extend and retract wheel engagement member 44, retainer balls 106 move along the surface of ring 104 into and out of ring openings 108. In this manner, the user is provided with a tactile click-type feel and sound as actuator 46 is rotated. In addition, the engagement of retainer balls 106 within ring openings 108 functions to prevent inadvertent rotation of actuator 46 when the manual force applied to actuator members 98 is relieved.

Figure 6A:
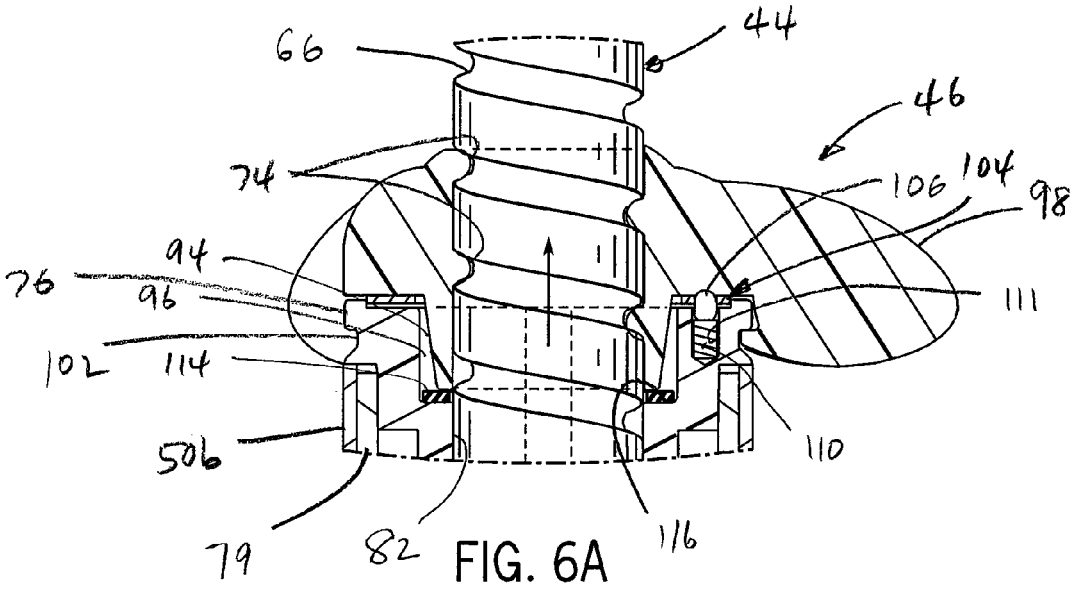
FIG. 6A is an enlarged partial section view, with reference to line 6A-6A of FIG. 4, showing a portion of the wheel mount when the wheel engagement is not engaged with the bicycle wheel.
Figure 6B:
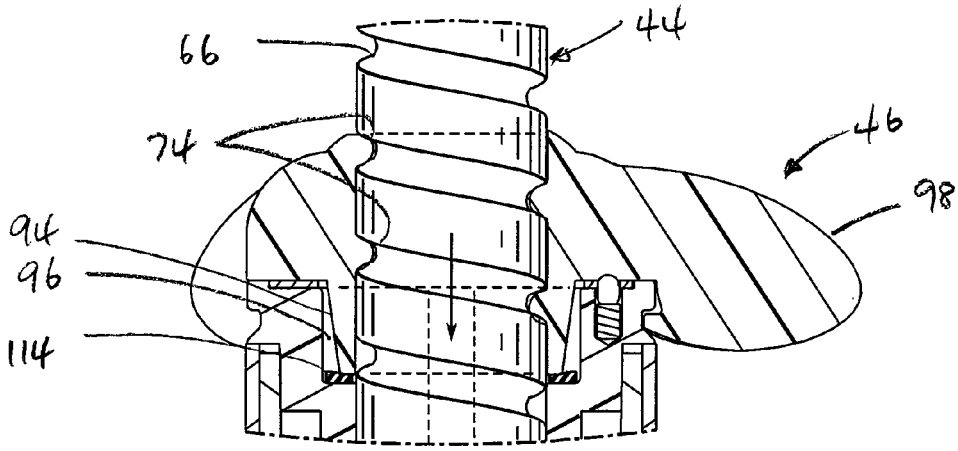
FIG. 6B is a view similar to FIG. 6A, showing a portion of the wheel mount when the wheel engagement is engaged with the bicycle wheel.

Referring to FIGS. 5, 6A and 6B, a resilient retainer gasket 114 is positioned within recess 96 between the inner wall of recess 96, shown at 116, and the end of guide lug 94. Retainer gasket 114 is normally in an uncompressed condition, as shown in FIG. 6A, such as when wheel engagement member 44 is not engaged with the skewer B of the bicycle wheel W. As actuator 46 is rotated so as to extend wheel engagement member 44, the end of wheel engagement member 44 comes into contact with the skewer B of the bicycle wheel W. During rotation of actuator 46, engagement of wheel engagement member 44 with the wall of mounting sleeve 72 at passage 82 functions to guide inward and outward movement of wheel engagement member 44, while engagement of the end of pin 86 within grooves 84 prevents rotation of wheel engagement member 44. As advancement of wheel engagement member 44 is continued, actuator 46 is moved axially against outer section 36 of mounting sleeve 72. Such movement of actuator 46 functions to compress springs 111 to increase the biasing force applied to retainer balls 106. In addition, such inward movement of actuator 46 compresses retainer gasket 114 between the recess end wall 116 and the end of guide lug 94. This compression of retainer gasket 114 cooperates with the threaded engagement between wheel engagement member 44 and actuator 46, as well as with engagement of the tab 100 within the groove 102, to ensure that actuator 46 does not inadvertently rotate during use of bicycle trainer 20.

It should be understood that the specific instruction of the manner in which wheel engagement member 44 and actuator 46 are engaged with the frame 22 of bicycle trainer 20 may vary from the specific embodiment as shown and described. That is, any other satisfactory construction for providing extension and retraction of a wheel engagement member upon rotation of a stationary actuator member is contemplated as being within the scope of the present invention, regardless of the manner in which such components are interconnected with the frame.

Various alternatives and embodiments are contemplated as being within the scope of the following claims particularly pointing out and distinctly claiming the subject matter regarded as the invention.

I claim:

1. A bicycle trainer for use with a bicycle having a driven wheel, comprising:

a frame;

a resistance arrangement interconnected with the frame; and a wheel mounting arrangement associated with the frame for securing the bicycle wheel to the frame, wherein the wheel mounting arrangement comprises first and second spaced apart wheel mount portions, wherein at least the first wheel mount portion includes an internally threaded actuator member rotatably interconnected with the frame, an externally threaded wheel engagement member, wherein the external threads of the threaded wheel engagement member are engaged with the internal threads of the threaded actuator member, and an axial guide arrangement associated with the first wheel mount portion and acting on the wheel engagement member for guiding axial movement of the wheel engagement member, wherein the guide arrangement restricts rotation of the wheel engagement member and wherein rotation of the threaded actuator member cooperates with the axial guide arrangement to cause extension and retraction of the threaded wheel engagement member by engagement of the internal threads of the threaded actuator member and the external threads of the threaded wheel engagement member, so as to move the threaded wheel engagement member toward and away from the second wheel mount portion to enable a bicycle wheel to be clamped between the second wheel mount portion and the threaded wheel engagement member.

2. The bicycle trainer of claim 1, wherein the threaded actuator member is located in a fixed position on the frame.

3. The bicycle trainer of claim 2, wherein the threaded actuator member includes one or more finger engagement members configured to facilitate manual engagement of the threaded actuator member by a user.

4. The bicycle trainer of claim 3, wherein the threaded actuator member comprises a hub section and wherein the one or more finger engagement members comprise a plurality of wing members that extend outwardly from the hub section.

5. The bicycle trainer of claim 2, wherein the threads of the actuator member and the threads of the wheel engagement member comprise lead threads.

6. The bicycle trainer of claim 5, wherein the frame defines a laterally extending passage, and wherein the wheel engagement member is interconnected with a sleeve positioned within the laterally extending passage, wherein the guide arrangement is interposed between the sleeve and the wheel engagement member.

7. The bicycle trainer of claim 6, wherein the guide arrangement comprises a laterally extending slot in the sleeve and an outward projection associated with the wheel engagement member, wherein the projection is engaged within the slot and moves within the slot to guide inward and outward movement of the wheel engagement member upon rotation of the threaded actuator member.

8. The bicycle trainer of claim 6, wherein the threaded actuator member is rotatably interconnected with the sleeve.

9. A bicycle trainer for use with a bicycle having a driven wheel, comprising:

a frame;

a resistance arrangement interconnected with the frame; and wheel mounting means associated with the frame for securing the bicycle wheel to the frame, wherein the wheel mounting means comprises first and second spaced apart wheel mount portions;

wherein at least the first wheel mount portion includes an internally threaded actuator means rotatably interconnected with the frame, an externally threaded wheel engagement means threadedly engaged with the internally threaded rotatable actuator means, and an axial guide means associated with the first wheel mount portion and acting on the wheel engagement means for guiding axial movement of the wheel engagement means, wherein the guide means restricts rotation of the wheel engagement means and wherein rotation of the rotatable actuator means cooperates with the axial guide means to cause extension and retraction of the wheel engagement means by engagement of the internal threads of the threaded actuator means and the external threads of the threaded wheel engagement means so as to move the wheel engagement means toward and away from the second wheel mount portion to enable a bicycle wheel to be clamped between the second wheel engagement area and the wheel engagement means.

10. The bicycle trainer of claim 9, wherein the wherein rotatable actuator means is located in a fixed position on the frame.

11. The bicycle trainer of claim 10, wherein the rotatable actuator means includes finger engagement means for facilitating manual engagement of the threaded actuator means by a user.

12. The bicycle trainer of claim 11, wherein the rotatable actuator means defines a hub, and wherein the finger engagement means comprises a plurality of wing members that extend outwardly from the hub.

13. The bicycle trainer of claim 9, wherein the frame defines a laterally extending passage, and wherein the wheel engagement means is interconnected with a sleeve positioned within the laterally extending passage, wherein the guide means is interposed between the sleeve and the wheel engagement means.

14. The bicycle trainer of claim 13, wherein the guide means comprises a laterally extending slot in the sleeve and an outward projection associated with the wheel engagement means, wherein the projection is engaged within the slot and moves within the slot to guide inward and outward movement of the wheel engagement means upon rotation of the rotatable actuator means.

15. The bicycle trainer of claim 13, wherein the rotatable actuator means is rotatably interconnected with the sleeve.

16. A method of securing a bicycle wheel to a bicycle trainer having a frame, wherein the bicycle wheel defines first and second sides, comprising the acts of:

positioning the first side of the wheel adjacent a first wheel engagement member;

rotating an internally threaded rotatable actuator member relative to the frame while maintaining the position of the rotatable actuator relative to the frame; and extending a second wheel engagement member toward the second side of the wheel in response to rotation of the rotatable actuator member by engagement of external threads on the second wheel engagement member with the internal threads of the rotatable actuator member, and guiding axial movement of the second wheel engagement member during rotation of the rotatable actuator member via guide structure interposed between the frame and the second wheel engagement member that restricts rotation of the second wheel engagement member, wherein extension of the second wheel engagement member by rotation of the rotatable actuator member and engagement of the internal threads of the rotatable actuator member with the external threads of the second wheel engagement member functions to clamp the bicycle wheel between the first and second wheel engagement members.

17. The method of claim 16, wherein the act of rotating the rotatable actuator member is carried out by rotating the rotatable actuator member relative to a sleeve that is secured to the frame, wherein the sleeve includes a passage and wherein the second wheel engagement member includes a threaded shaft that is movable within the passage of the sleeve, and wherein the guide structure comprises a guide slot in the sleeve, and a projection extending from the threaded shaft that is engaged within the guide slot to guide movement of the second wheel engagement member upon rotation of the rotatable actuator member.

* * * * *